United States Patent [19]

Kuo

[11] 4,376,590

[45] * Mar. 15, 1983

[54] WRITING IMPLEMENT

[76] Inventor: Chun-Liang Kuo, No. 328, 2nd Floor, Cheng Yi North Rd., San Chung City, Taipei Hsien, Taiwan

[ * ] Notice: The portion of the term of this patent subsequent to Aug. 26, 1997, has been disclaimed.

[21] Appl. No.: 177,793

[22] Filed: Aug. 13, 1980

Related U.S. Application Data

[63] Continuation-in-part of Ser. No. 74,825, Sep. 12, 1979, which is a continuation-in-part of Ser. No. 919, 039, Jun. 26, 1978.

[51] Int. Cl.[3] ..... B43K 21/16

[52] U.S. Cl. ..... 401/57; 401/65; 401/82; 401/85; 401/90; 401/94

[58] Field of Search ..... 401/57, 84, 90, 93, 401/94, 67, 73, 65, 85, 82

[56] References Cited

U.S. PATENT DOCUMENTS

| | | | |
|---|---|---|---|
| 603,183 | 4/1898 | Goldsmith | 401/73 |
| 1,124,786 | 1/1915 | Murchey | 401/65 |
| 4,219,282 | 8/1980 | Kuo | 401/57 |

FOREIGN PATENT DOCUMENTS

| | | | |
|---|---|---|---|
| 1103083 | 10/1955 | France | 401/94 |
| 556942 | 2/1957 | Italy | 401/94 |
| 13969 | of 1892 | United Kingdom | 401/57 |

*Primary Examiner*—Steven A. Bratlie
*Attorney, Agent, or Firm*—Tak Ki Sung

[57] ABSTRACT

This invention relates to a writing implement comprising an outer casing, a coil spring disposed within the casing, an inner tube inserted through the coil spring and having a plurality of presharpened pieces of pencil lead stored therewithin, and a capping member fitted over the open end of the inner tube. The lower (writing) portion of the inner tube is split into two clamping halves. The lower end of the coil spring is formed into a hook which slides along the slot formed between the clamping halves to allow the expelling and feeding of presharpened pieces of pencil lead into the space between said two clamping halves.

9 Claims, 23 Drawing Figures

WRITING IMPLEMENT

This is a continuation-in-part of application Ser. No. 74,825 filed Sept. 12, 1979, which is a continuation-in-part of 919,039, filed June 26, 1978.

FIELD OF THE INVENTION

The present invention is related to a writing and drawing pencil, in which the lead can be changed automatically and in which the leads are presharpened, thus requiring no sharpening.

BACKGROUND OF THE INVENTION

Ever since the introduction of "presharpened" pencils in the market, numerous forms and kinds of such pencils have been made available. However, upon further investigation, it is found that the construction of these pencils is not only very complicated, but also inconvenient in use and have many disadvantages.

The primary objective of the present invention is to provide a special construction in a presharpened pencil in order to facilitate writing, as well as to eliminate the disadvantages of conventional presharpened pencils.

The following are some of the advantageous characteristics of the present invention:

(1) The present invention adopts the "direct pressing" method in which the user empolys a one-handed operation to quickly push out or change the pencil lead for the purpose of writing. The convenience and simplicity of this operation have never been made available. The previous presharpened pencils have never exhibited such desirable characteristics.

(2) While in use, the lead in the present pencil is tightly pressed against the lower end of the pencil so that there is no wobbling or vibrating, thus providing an extremely stable operation.

(3) When changing or refilling the leads in the present pencil, the user's fingers do not come in contact with the somewhat poisonous lead. This is one of the most outstanding advantages of the present invention—to prevent the fingers from getting dirty, which is beneficial to the health of the users (e.g. students).

(4) In the present invention, the lead sections do not require lead holders or collars, which means easier manufacturing and lower costs.

(5) In one embodiment of the present invention, the retraction of an exposed lead into the pencil is permitted. Thus, there is no need for an additional cap to cover or protect the lead.

(6) Since the construction of the present invention is particularly simple, the parts can easily be made without fabrication by injection molding. As the manufacturing process is simplified, the cost is decreased substantially.

In addition to those described above, the other objectives, effectiveness and features of the present invention are described in detail as follows in conjunction with the appended drawings.

DETAILED DESCRIPTION OF THE PRESENT INVENTION

Figures 1A, 1B, 1C:
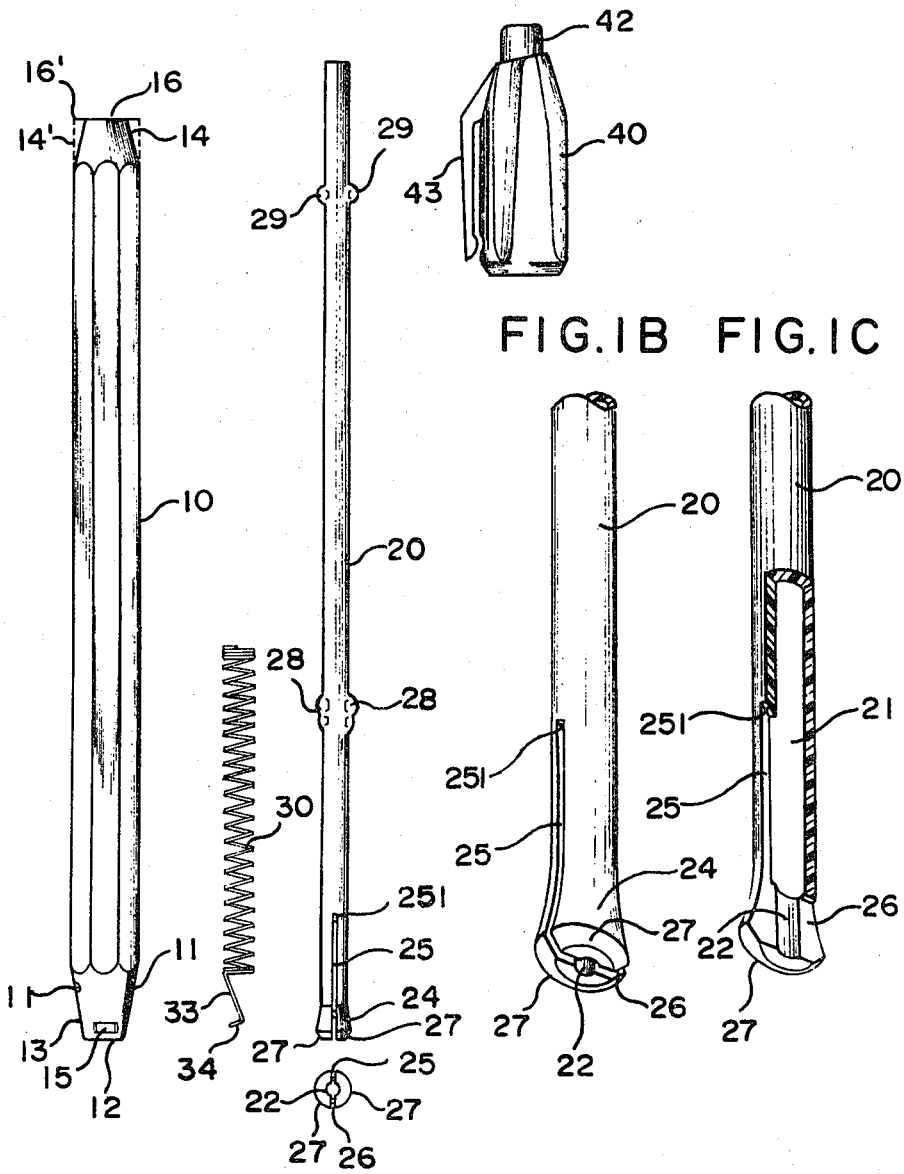
FIG. 1A is a three-dimensional sketch of the separate parts of the first embodiment according to the present invention.
FIG. 1B is a perspective view of the lower portion of the inner tube of the first embodiment according to the present invention.
FIG. 1C is a perspective view of the lower portion of the inner tube of the first embodiment according to the present invention, wherein one of the clamping halves is broken away to reveal the interior of the lower portion of the inner tube.
Figure 2:
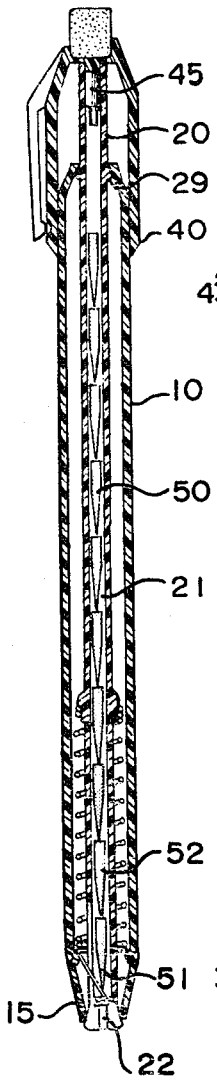
FIGS. 2–6 are cross-sectional diagrams of the first embodiment according to the present invention, showing the various stages of operation in releasing pencil leads.

As shown in FIG. 1A, the first embodiment of the present invention comprises an outer casing 10, a coil spring 30, an inner tube 20 and a capping member 40. The outer casing 10 is made of a hollow round tube by a pipedrawing extrusion method, with the two opposite ends 13, 14 being tapered to form a generally conical shape. Each end has an appropriate opening 12 and 16 respectively, each of said openings having a smaller diameter than that of the casing 10. Two depressions 11-11, the purpose of which will be explained later, are provided near the upper end of tapered end 13. Below the depressions 11-11, there is provided an opening 15, the purpose of which will also be explained later. The interior of the inner tube 20 is provided with a channel 21 in which a plurality of pre-sharpened pieces of a writing material (e.g. pencil lead), 50 as shown in FIG. 2, are stored. The lowermost end of channel 21 is formed into a lower tube channel 22 having a slightly smaller diameter (FIG. 1C). The smaller diameter of lower tube channel 22 is for preventing the lowermost piece of pencil lead 50 from passing therethrough, so that the leads 50 are held within the inner tube 20. Through the uppermost end of tube channel 21, new leads are fed into inner tube 20. The exterior of the lowermost end of inner tube 20 is enlarged to form conical head 24, which is tapered inwardly towards the longitudinal axis of inner tube 20 to form clamp portions 27 (FIG. 1B). Two slots 25, 26 are made in conical head 24 to form two clamping halves, i.e. to bisect said enlarged conical head 24 into two semi-circular lead clamp portions 27. Slot 26, formed on the enlarged conical head 24, is shorter and the other slot 25 formed on head 24 and the lower portion of tube 20, is much longer. Slot 26 is about half the length of a preshaped lead which is usually about 1 cm long and slot 25 is preferably about 4 to 6 times the length of slot 26. The closed end of slot 25 has a sloping bottom wall 251 to facilitate the gliding of the hooked tip 34 of coil spring 30 thereon. In addition, two protrusions 28 are provided on the exterior surface of tube 20, at a distance of from about $\frac{1}{3}$ to about $\frac{1}{2}$ of the length of tube 20 from conical clamp 27 (FIG. 1A). The protrusions act as means for pressing on the open end of coil spring 30. The positioning of protrusions 28 can be varied in accordance with the length of coil spring 30 as well as the compression strength of the coil spring. Protrusions 28 comprise two adjacent sets of projections, one having a greater height than the other. The set of projection having a smaller height is located near the writing end of the pencil. This projection is for engaging the upper end of coil spring 30 so that the spring will not slip off inner tube 20 during assembly. Protrusions 28 are for pressing on coil spring 30 when the inner tube 20 is placed within outer casing through coil spring 30. Near the upper end of the inner tube 20, two protrusions 29-29 are provided for pressing against the inner surface of the upper end 14 of outer casing 10 to retain inner tube 20 within outer casing 10 after the insertion of inner tube 20 and coil spring 30 therein. It is important to note that the lower end of spring 30 comprises a coil portion and a writing material-pushing portion comprising a straight wire 33 and a hooked tip 34 bent outwardly, i.e. away from the interior of tube 20. The length of the hooked tip 34 is larger than that of the outside diameter of the rear blunt end of the pencil lead. Upon inserting inner tube 20 into outer casing 10 through coil spring 30, care is exercised so that hooked tip 34 and straight wire 33 are aligned with slot 25. That is, when inner tube 20 is inserted through coil spring 30, lead-pushing member 33 at the lower end of coil spring 30 is forced into slot 25, causing tip 34 to extend into the junction between tube channel 21 and front tube channel 22. As a result, tip 34 can either effectively press onto or block against pencil lead 50.

As shown in FIG. 1A, capping member 40 has clip 43 and eraser block 42. FIGS. 2 through 10 show that capping member 40 is additionally provided with tapered stopper 45. Stopper 45 which is integral with capping member 40 is smaller than inner tube 20 in diameter. Stopper 45 is located on the interior wall of the closed end of capping member 40. In an assembled position, stopper 45 is inserted into the end of tube 20. Capping member 40 is thus slipped over the end of tube 20 to serve as an actuator button for the pencil as well as a cap in order to prevent leads 50 from falling out of tube channel 21.

It should be noted that before the assembling of the present pencil the upper end 14′ of outer casing 10 as indicated in dotted lines in FIG. 1A is as large as the middle portion of the outer casing in diameter. The upper opening corresponding to upper end 14′ is now referred to as 16′. To assemble the present pencil, first, inner tube 20 with the head 24 aligned toward the writing end of the pencil is inserted through the rear end of coil spring 30 until lead-pushing member 33 of coil spring 30 is glided or rotated into alignment with slot 25. Second, inner tube 20 assembled with coil spring 30 is inserted through upper opening 16′ into the lower portion of outer casing 10, with the upper portion of lead-pushing member 33 being tightly fastened onto depressions 11-11 of outer casing 10. As a result, the lower ends of the two lead clamps 27-27 project slightly outside of opening 12 (when the two lead clamp portions 27-27 containing no pencil lead therein are pressed together, their outside diameter will be slightly smaller than opening 12, therefore they can project out). After inner tube has been properly inserted, the upper end 14′ of outer casing 10 is heat-pressed inwardly onto the upper projections 29-29 of inner tube 20 to form a smaller upper end 14 so as to firmly secure inner tube 20 within outer casing 10. Capping member 40 is then slipped over upper end 14 by inserting tapered stopper 45 into the upper opening of inner tube 20, thereby completing the assembling of the first embodiment of the present invention.

Figure 3:
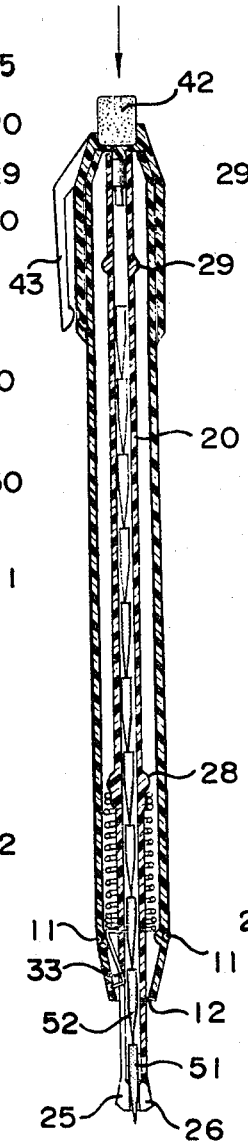
Figure 4:
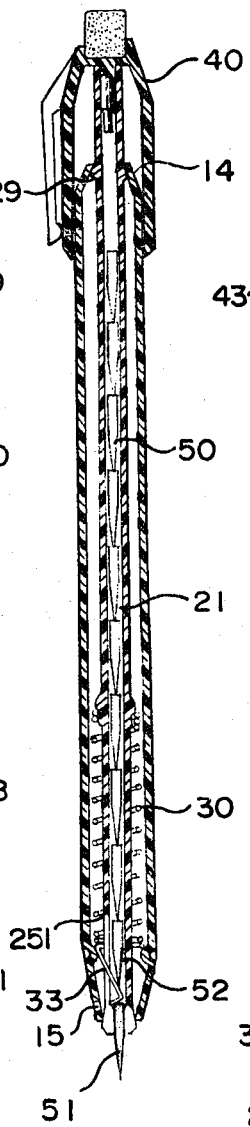
Figure 5:
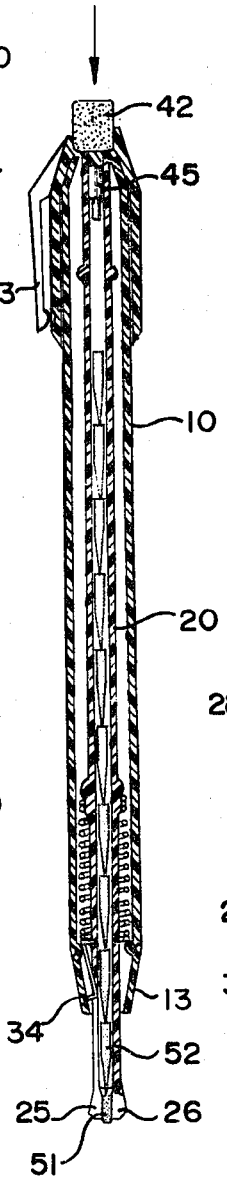
Figure 6:
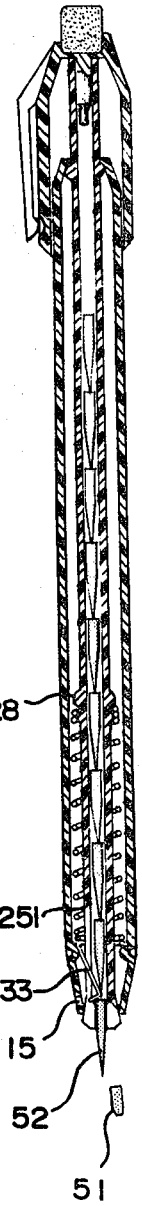
Figures 7, 8, 9, 10:
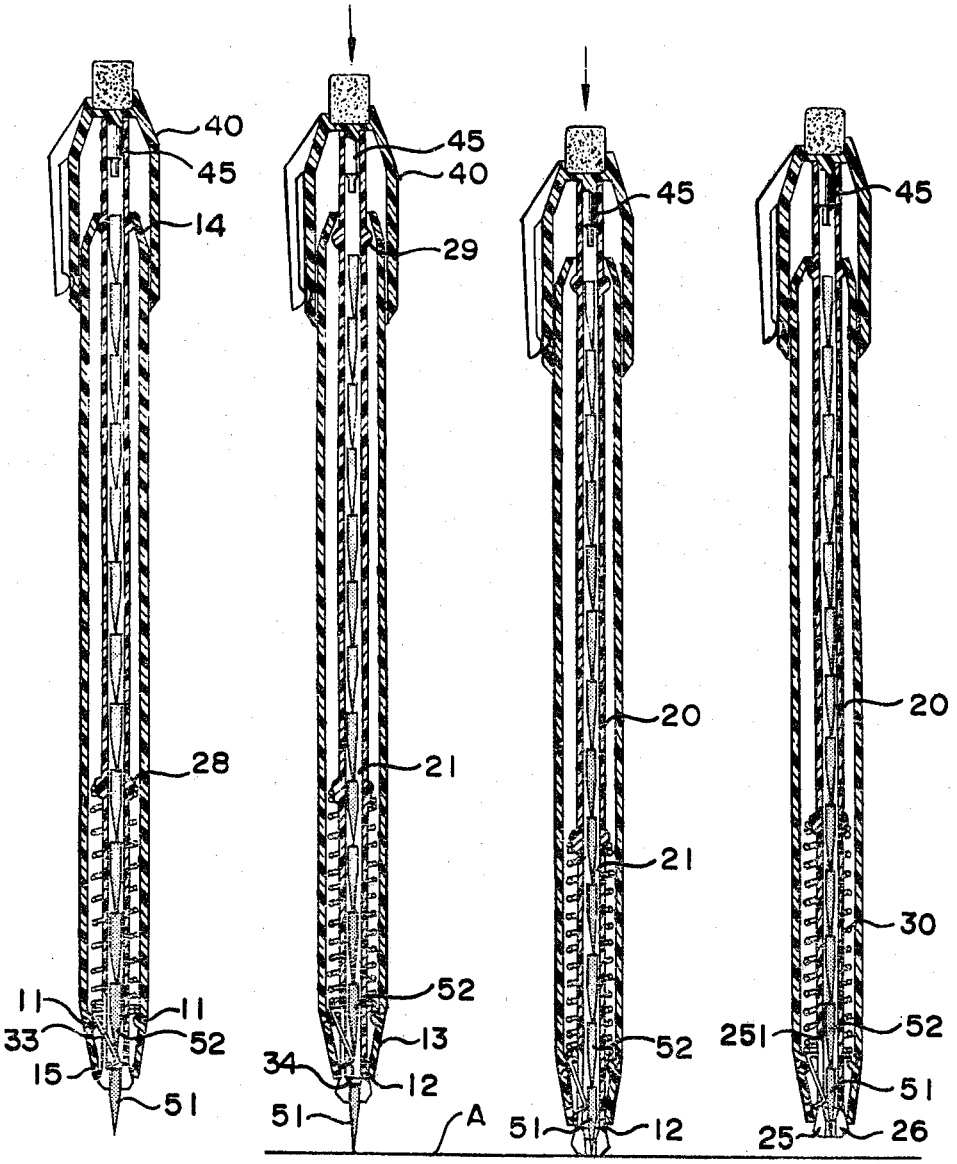
FIGS. 7–10 are cross-sectional diagrams of the first embodiment according to the present invention, showing the various stages of operation in retracting the pencil leads.

FIGS. 2 through 6 show the various stages involved in operating the present pencil. When tube channel 21 is completely filled with presharpened lead pieces in single file, the capacity is usually about twelve sections. The lead pieces are stored in a front-to-end fashion with the sharpened end of each piece being pointed towards the writing end of the present pencil. FIG. 2 shows the pencil before being used. When the user starts to press or push capping member 40 downwardly, protrusions 28-28 force coil spring 30 to be compressed, as in FIG. 3. Lead clamps 27 of inner tube 20 are fully projected outside opening 12 of outer casing 10. On the other hand, lead-pushing member 33 of coil spring 30 slides along slot 25 due to the downward shift of lead clamps 27. When lead-pushing member 33 reaches the end wall 251 of slot 25, the hooked tip 34 is forced to extend into opening 15. At this time, the first piece of pencil lead 51 in inner tube 20 is no longer blocked by lead-pushing member 33 and is subsequently released. It falls automatically through the foremost end of tube channel 21. However, since lowermost tube channel 22 is slightly smaller in diameter than lead 51, the lead is thus retained therein. The point of lead 51 extends through the lowermost tube channel 22 and is exposed to the outside as shown in FIG. 3. The user then removes his finger from capping member 40, thus releasing the pressure. As a result, lead clamp 27-27 of inner tube 20 is withdrawn into the outer casing 10 as coil spring 30 returns to almost its original length. Lead-pushing member 33 is returned to tube channel 21 after gliding through slot 25. Upon further retraction of inner tube 20, member 33 comes into contact with the blunt end of lead 51, thus pushing lead 51 further out of channel 21 into the lowermost end of tube channel 22. When inner tube 20 is returned to its original position (that is, upper protrusions 29-29 are stopped by the inner surface of the upper opening 16 on outer casing 10) the first lead section 51 is pushed completely into the lowermost end of tube channel 22 of inner tube 20, as shown in FIG. 3. As a result of the insertion of lead 51 into lead clamps 27, the outside diameter of the clamps is slightly increased so that said diameter is larger than that of opening 12 of outer casing 10. When the user presses the pencil down onto the writing surface, an upward pressure is exerted, pushing the front end of inner tube into outer casing 10. Since the outside diameter of the clamps is slightly larger than that of opening 12, this inward pressure forces the clamps into opening 12 so as to form an extremely tight grip on exposed lead 51. Thus, there is no wobbling or vibrating in lead 51, which leads to a very stable writing or drawing operation. When the first section of lead 51 has become blunt due to use and has to be replaced by second lead section 52, the above process may be repeated by pressing down on capping member 40, making the two lead clamps 27-27 extend out of outer casing 10 as shown in FIG. 5. By releasing the pressure, the lead-pushing member 33 pushes the second section of lead 52 into channel 22, which pushes the blunt used lead 51 completely out of inner tube 20. However, since lead clamps 27-27 are still partially open when lead 51 is expelled, the removal of lead 51 is easily performed, without any damage to the point of lead 52 (see FIG. 6). The above description is detailed particularly for the sake of understanding the working principle of the present invention. It should be noted that during actual use, the pushing and releasing movements are continuous and rapid, and that little exertion in handling and operation is required of the user.

In the above-described embodiment of the present invention, the pencil lead, used or not used, can be withdrawn into the inner tube 20. The stages of withdrawing the pencil lead are shown in FIGS. 7 through 10. The user simply puts the front end of an exposed pencil lead against any surface such as a table top and presses capping member 40 lightly to have the two lead clamps 27-27 project slightly outside of opening 12 of outer casing 10 to form an opening. In the meantime, the rear blunt portion of the exposed lead forces hooked tip 34 of lead-pushing member 33 away into opening 15 and the lead enters tube channel 21. In other words, since the length of hooked tip 34 is larger than that of the outside diameter of the rear blunt end of the pencil lead, the rear blunt end of the exposed lead can slide along the hooked tip to re-enter inner tube 20. Thus, as the pressure is released, the entire lead section is withdrawn into the tube channels 21 and 22. Therefore, this embodiment of the invention has the additional advantage of requiring no protective cap or cover for the lead.

In the event that it is not desired to have the lead retracting feature in the present invention, this can be accomplished by eliminating hooked tip 34, i.e. only straight portion 33 is used. In this case, opening 15 in the lower end of outer casing 10 is no longer necessary and need not be formed.

Figure 11:
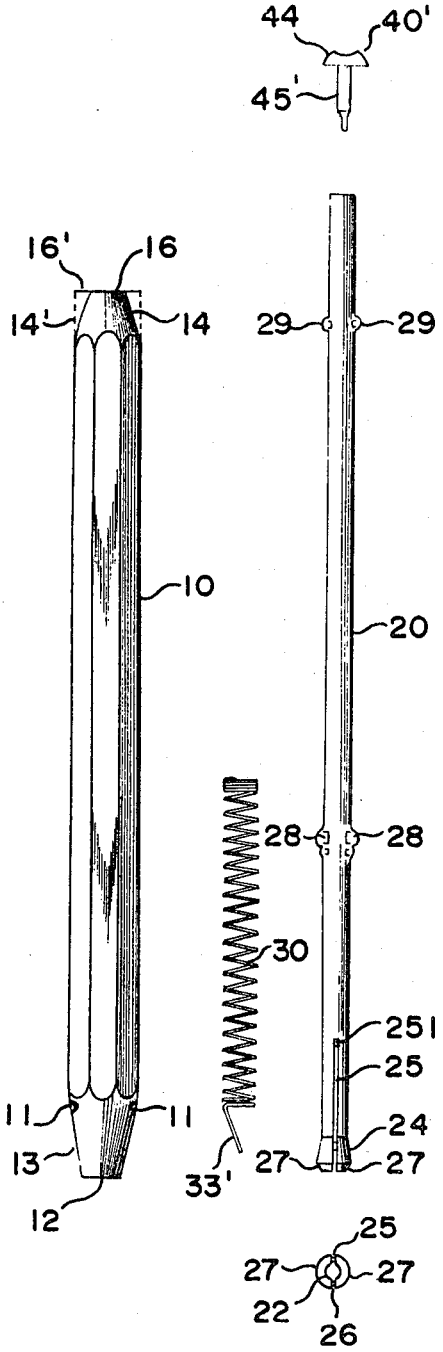
FIG. 11 is a three dimensional sketch of the separate parts of the second embodiment according to the present invention.
Figure 12:
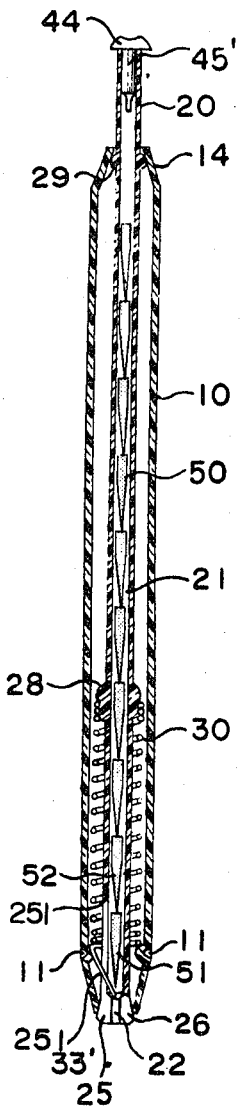
FIG. 12 is a cross-sectional view of the second embodiment according to the present invention.
Figure 12A:
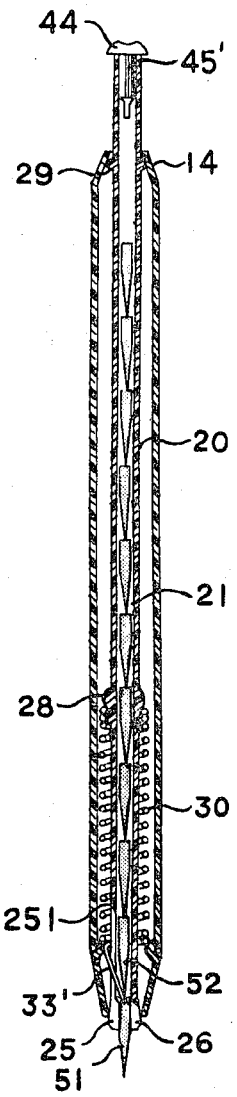
FIG. 12A is a cross-sectional view of the second embodiment according to the present invention, with the lead exposed.

Shown in FIG. 11 is another embodiment of the present invention. It differs from the above embodiment in that first, the lead-pushing member 33 has no provision of a hooked tip; second, the capping member 40 comprises a head 44 and a tapered stopper 45'; and third, opening 15 is not formed in the lower end of outer casing 10. Since this embodiment does not have the lead retracting feature, it requires almost the same operation as the first embodiment to release the pencil leads for use. Therefore, it is not necessary to describe the detailed stages of operation of this embodiment here. FIGS. 12 and 12A show the cross-sectional views of the present invention when the lead is not exposed and exposed, respectively.

Furthermore, in the above-described embodiment, cap member 40 may be replaced by plug-like capping member 40' shown in FIG. 11. Plug 40' is adapted for insertion into the upper open end of inner tube 20. Plug 40' comprises a tapered stopper 45' and head portion 44. Tapered stopper 45' has a diameter sufficiently smaller than the inside diameter of inner tube 20 so that stopper 45' is capable of frictionally engaging the inside surface of tube 20. As to head portion 44, it preferably has a diameter slightly larger than the outside diameter of tube 20 in order to facilitate the easy removal of plug 40' after being inserted into tube 20. However, if it is desired to seal the upper open end of tube 20 head portion 44 may be made to have a diameter smaller than the outside diameter of tube 20. In fact, in such a case, plug member 40' can comprise only stopper 45'. As it can be readily appreciated, plug 40' is for the purpose of sealing the open end of tube 20 and may be formed into any convenient shape as long as plug 40' can be fitted over the open end of tube 20 to prevent lead pieces 50 from exiting.

Furthermore, upper protrusions 29 and lower protrusions 28 are for the purpose of restricting the travel of inner tube 20. As such, it may be formed in any convenient shape, provided that the above mentioned purpose is achieved.

Figure 17:
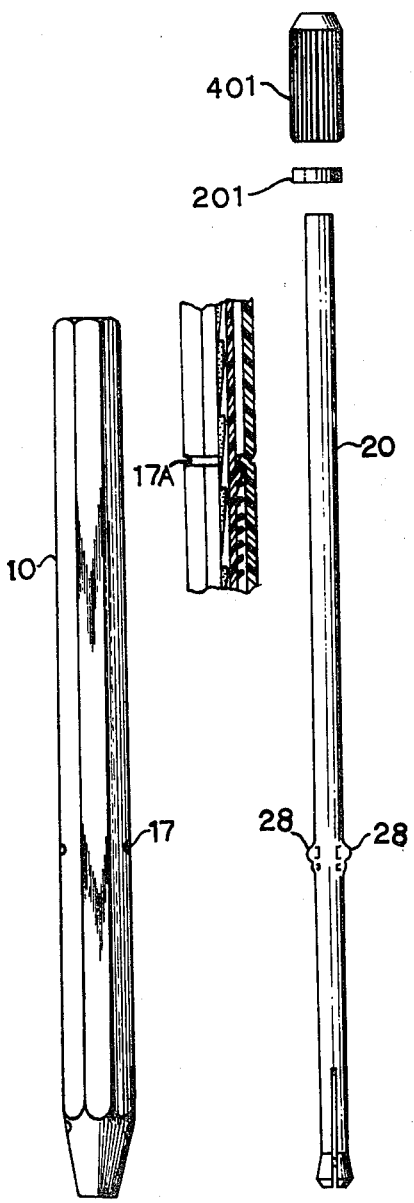
FIG. 17 is a sketch drawing of the third embodiment of the present invention, showing the modified arrangement of the outer tube, the inner tube and the capping member.
Figure 18:
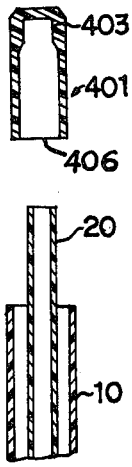
FIG. 18 is a cross-sectional view of the capping member and the upper portion of the inner tube and outer tube of the third embodiment.

In the third embodiment of the present invention shown in FIGS. 17 and 18, the upper end of outer casing 10 is not tapered. In this embodiment, cap member 401 comprises a tube member having a closed end 403 and an open end 406. The inside diameter of tube member 401 is greater than the outside diameter of inner tube 20. Wall thickness of 406 is such that cap member 401 fits into the annular space defined between inner tube 20 and outer casing 10. As is readily apparent, cap 401 may be made to any suitable length. Preferably, closed end 403 is tapered so that it will frictionally engage the open end of inner tube 20 but can be readily removed by using limited force.

In the embodiment described in the preceeding paragraph, it is possible for inner tube 20 to be removed from outer casing 10. To prevent such a possibility, retaining means may be provided on inner tube 20 or outer casing 10. For example, a depression 17 may be formed on outer tube 10 at a location opposite to and above lower protrusion 28 (on inner tube 20). Depression 17 can also be a continuous, annular groove 17A to form an annular flange in the outer casing instead of individual projections. In the case of a plurality of projections, a washer 201 is employed, the washer 201 being passed over the inner tube 20 in which upper protrusions 29 as introduced in the previous embodiment are eliminated in this embodiment, and retained by lower protrusions 28.

The above-mentioned depression 17 or 17A is formed after inner tube 20 having the washer 201 in the case of depression 17 and coil spring 30 have been inserted into outer tube. The depth of the depression in outer tube 10 is such that it is sufficient to block the passage of protrusions 28 or washer 201.

Figure 19:
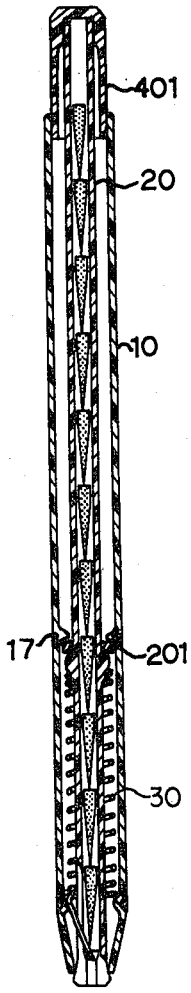
FIGS. 19 and 20 are cross-sectional diagrams of the third embodiment, showing the third embodiment being incorporated with the coil springs used in the first and second embodiments respectively.
Figure 20:
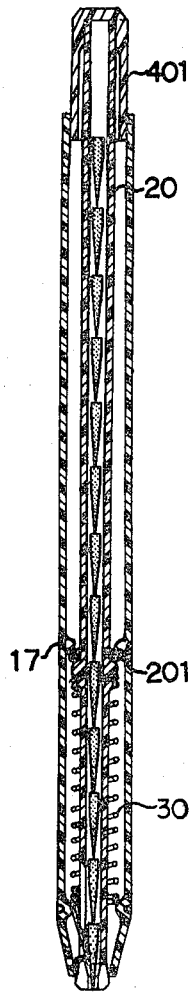

It is to be noted that the third embodiment as described above can be incorporated with the coil spring 30 having or not having the hooked tip 34 shown in FIG. 1A, which are illustrated in FIGS. 19 and 20.

As a further example, protrusion 28 on inner tube 20 may be formed to extend around the entire outer perimeter of inner tube 20. After the insertion of inner tube 20 and coil spring 30, one or more depressions may be formed on outer casing 10 at a location above lower protrusion 28 to block the exit of inner tube 20. As is readily apparent, numerous other method of blocking the exit of inner tube 20 are available by providing means on the inner and outer tubes to achieve this goal.

Figures 13, 14, 15, 16:
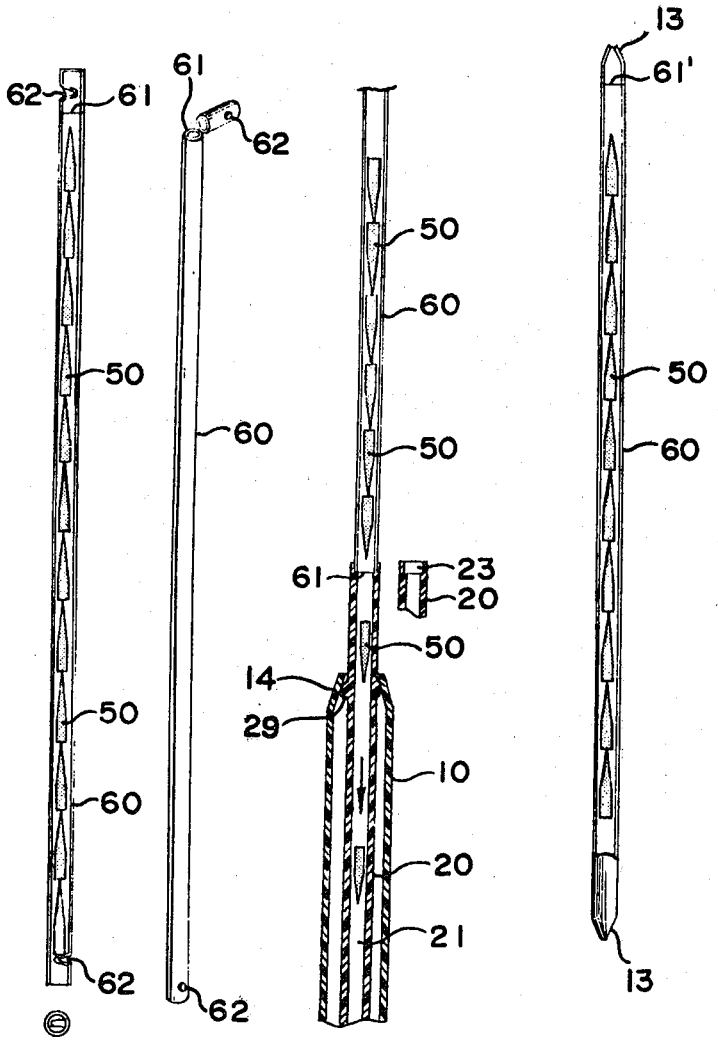
FIG. 13 is a diagram of the first embodiment of a cartridge according to the present invention.
FIGS. 14 and 15 are diagrams of the first embodiment of the cartridge according to the present invention, showing how to feed the fresh pieces of pencil lead into the emptied inner tube.
FIG. 16 is a diagram of the second embodiment of the cartridge according to the present invention.

FIG. 13 shows an embodiment of a plastic spare tube 60 filled with a plurality of presharpened pencil leads. As shown in FIG. 13, each of the opposite ends of the spare tube 60 is pressed to form a depression 62 so as to prevent the pencil leads from falling out of the tube. Furthermore, spare tube 60 is scored at 61 below depression 62 toward which the pencil leads point. As shown in FIGS. 14 and 15, by breaking away the upper end of spare tube 60 at 61 and then inserting the opened end of spare tube 60 into the upper opening of the inner tube 20, the lead pieces 50 will fall into inner tube 20 one by one so as to fill it completely, as shown in FIGS. 2 and 12. FIG. 16 shows another embodiment of the spare tube. It differs from the above embodiment only in that it has two opposite ends heat-pressed in a convergent manner. According to these two embodiments of spare tube 60, the filling of new pencil leads can be done conveniently and without dirtying the user's fingers. However, should one prefer, the lead may be inserted individually into inner tube 20 without using plastic spare tube 60.

The pre-sharpened pieces of writing material used in the present invention is preferably black pencil lead. Other writing materials which can be utilized in the present invention and, therefore, are within the scope hereof, include colored pencil leads, crayons, paraffin pencils, and the like.

What is claimed is:

1. A writing implement comprising:

an outer casing having an open converging lower end and an open upper end, the lower end being provided with a plurality of depressions near the top of the converging lower end and an opening below said depressions and near the distal end of said casing;

a coil spring disposed within the outer casing, the coil spring having a free upper end and a lower end comprising a coil portion and a writing material-pushing portion comprising a straight wire extending at an angle with the longitudinal axis of the coil spring said straight wire having a tip formed into a hook to correspond with said opening in the outer casing, the coil portion and writing material-pushing portion being formed integrally, the coil portion adapted to contact the depressions in the lower end of the outer casing;

an inner tube having an open upper end and a lower end and inserted into the outer casing and through the coil spring, the inner tube having an inside channel for for storing a plurality of presharpened pieces of a writing material, the lower end of the inner tube being formed into conical clamp portions, said conical clamp portions increasing in diameter towards the lower end of the inner tube and having two slots extending from the lower open end and along the longitudinal axis of the inner tube, one of said two slots being adapted to receive therein said writing material-pushing portion and provided with an end wall slanting upwardly toward the upper end of the inner tube, the inside diameter of the inner tube being reduced at the lowermost end by an amount sufficient to frictionally hold the writing material stored therein, pressing means disposed on the outside surface of the inner tube at a distance of from about $\frac{1}{3}$ to $\frac{1}{2}$ the length of the inner tube from the lower end of the inner tube, said pressing means adapted for pressing on the open end of the coil spring; and a capping member adapted for blocking the open upper end of the inner tube.

2. The writing implement of claim 1 wherein the outer casing is provided with retaining means for preventing the removal of the inner tube and the coil spring from the outer casing.

3. The writing implement of claim 2 wherein the retaining means comprises a depression formed in the outer casing and extending around the perimeter of the outer casing at a location above the pressing means on the inner tube.

4. The writing implement of claim 2 wherein the upper open end of the outer casing is pressed to form a converging opening and the retaining means comprises a plurality of protrusions provided near the top of the inner tube to press against the inner wall of the converging upper end.

5. The writing implement of claim 1 wherein the pressing means comprises two adjacent sets of projections of different heights, the first set being located closer to the lower end of the inner tube and having a lesser height, the second set having a greater height and being located closer to the upper end of the inner tube, the heights of the projection sets being so arranged that the upper end of the coil spring is retained between the projections.

6. The writing implement of claim 1, 2, 3, 4 or 5 wherein the capping member comprises a cylindrical tube having one open end and one closed end, the cylindrical tube having a wall thickness less than the annular space between the outer casing and the inner tube, the closed end of the capping member capable of frictionally engaging the open upper end of the inner tube.

7. The writing implement of claim 1, 2, 3, 4 or 5 wherein the capping member comprises a head portion and a tapered cylindrical body portion adapted for insertion into the open upper end of the inner tube, the head portion having a diameter greater than the outside diameter of the inner tube.

8. The writing implement of claim 1, 2, 3, 4 or 5 wherein the capping member comprises a head portion and a tapered cylindrical body portion adapted for insertion into the open upper end of the inner tube, the head portion having a diameter smaller than the outside diameter of the inner tube.

9. The writing implement of claim 1, 2, 3, 4 or 5 wherein the writing material is selected from the group consisting of pencil lead, crayon and paraffin lead.

* * * * *